United States Patent [19]

Boaz

[11] 4,137,447

[45] Jan. 30, 1979

[54] ELECTRIC HEATER PLATE

[75] Inventor: Premakaran T. Boaz, Southgate, Mich.

[73] Assignee: Ford Motor Company, Dearborn, Mich.

[21] Appl. No.: 900,947

[22] Filed: Apr. 28, 1978

[51] Int. Cl.[2] ..... H05B 3/06

[52] U.S. Cl. ..... 219/522; 219/203; 219/543; 219/541; 219/547; 338/309; 338/322

[58] Field of Search ..... 219/203, 522, 541, 543, 219/547; 428/210; 338/308, 309, 319, 320, 322, 328; 52/171

[56] References Cited

U.S. PATENT DOCUMENTS

| | | | |
|---|---|---|---|
| 3,634,654 | 11/1972 | Peetz et al. | 219/522 |
| 3,792,232 | 2/1974 | Zarenko | 219/522 |
| 3,794,809 | 2/1974 | Beck et al. | 219/203 |
| 3,813,519 | 5/1974 | Jochim et al. | 219/522 |
| 3,895,218 | 5/1975 | Cooke | 219/543 |
| 3,995,142 | 11/1976 | Ciardelli et al. | 219/522 |
| 4,048,469 | 9/1977 | Ciarniello et al. | 219/203 |

*Primary Examiner*—Volodymyr Y. Mayewsky
*Attorney, Agent, or Firm*—William E. Johnson; Keith L. Zerschling

[57] ABSTRACT

An electric heater plate is disclosed which is formed on one surface of a sheet of tempered glass. The one surface of the tempered glass sheet has a plurality of thin lines of a silver ceramic material bonded thereto, the thin lines extending in a generally parallel but spaced apart relationship across the sheet of glass. Left hand and right hand end portions of the plurality of thin lines are interconnected by a thin interconnection strip of a silver ceramic material. A small terminal area of silver ceramic material is also associated with each of the interconnection strips located at opposite ends of the plurality of thin lines. A termination area is also bonded to the one surface of the sheet of tempered glass at a position spaced from the left hand and right hand interconnection strips. A thin copper strip is bonded to each of the terminal areas and the termination area associated with the left hand or the right hand interconnection strip to electrically interconnect the same. Electrical leads are connected to each of the pair of termination areas to provide a connection to a power system. When the power system is actuated, current flows through the plurality of thin lines in order to heat the tempered glass sheet. If the tempered glass sheet is installed as the rear window of a motor vehicle, the heat generated by flowing the current through the thin lines can de-fog and de-ice the window.

2 Claims, 3 Drawing Figures

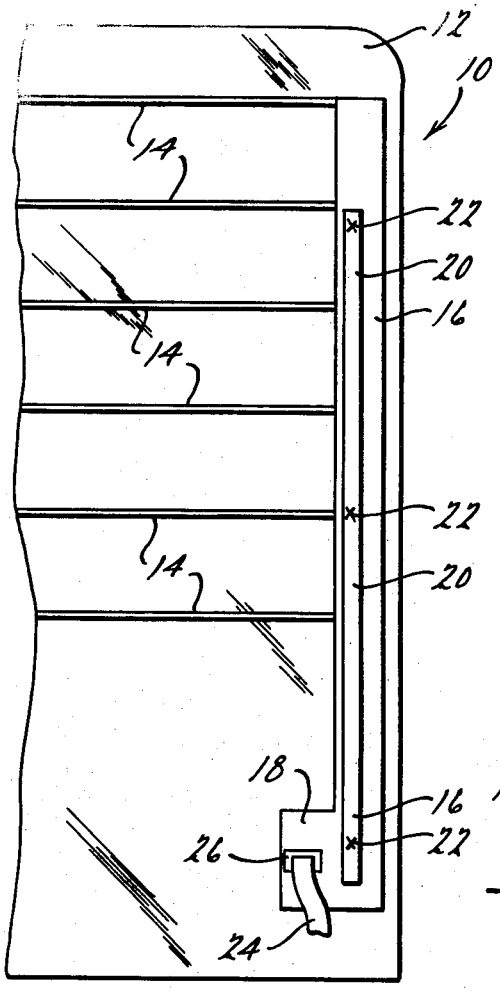
Prior Art
FIG. 1.
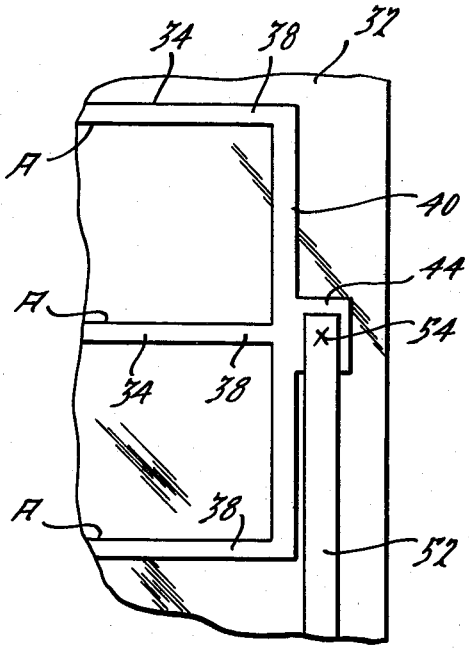
FIG. 3.
FIG. 2.
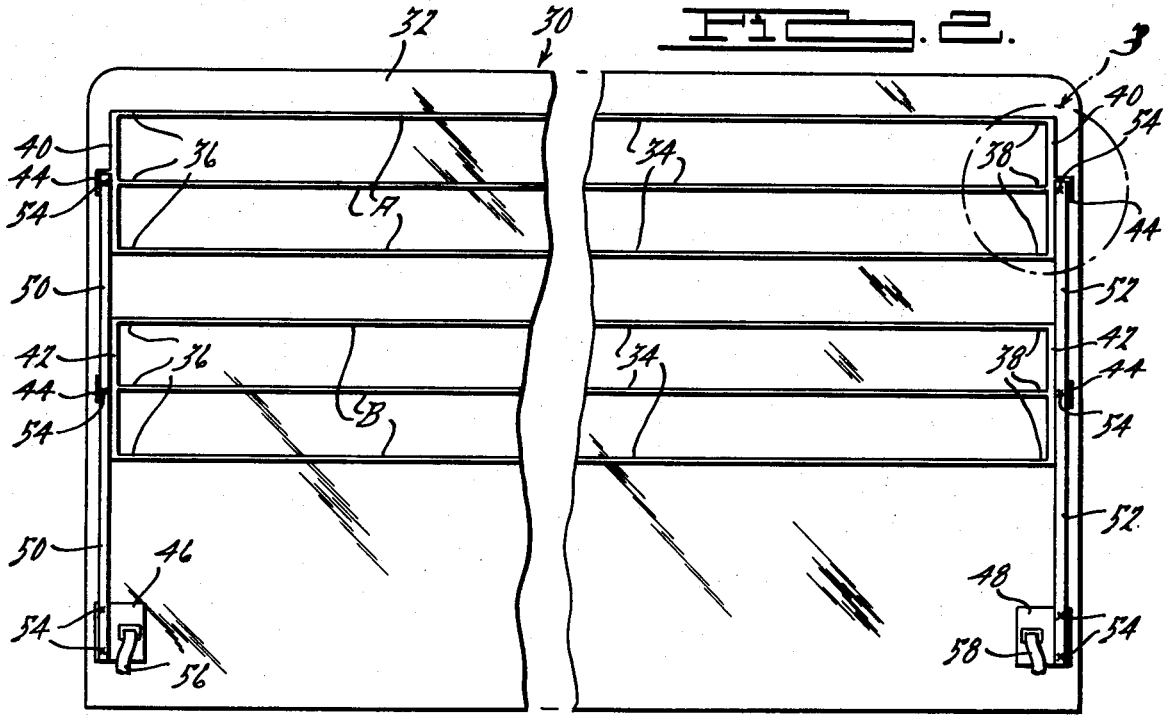

ELECTRIC HEATER PLATE

BACKGROUND OF THE INVENTION AND PRIOR ART STATEMENT

A novelty study conducted on the subject matter of this application, resulted in the citation of the following U.S. Pat. Nos.: 3,792,232; 3,794,809; 3,864,545; 3,895,218; and 3,995,142. Of the patents cited, the only one which appeared relevant to the subject matter presently claimed in this application is U.S. Pat. No. 3,995,142.

U.S. Pat. No. 3,995,142 issued on Nov. 30, 1976 for Defogging Rear Window Pane for Motor Vehicles. The structure defined in this patent is one wherein a plurality of spaced, wire heating elements are embedded in a pane of glass. A relatively short metallic collector, also embedded in the glass pane and having a circular segment configuration, is provided in each peripheral side of the pane at opposite margins thereof. A central wire heating element extends between the collectors in a rectilinear path. Additional wire heating elements above and below the central element have a rectilinear central portion parallel to the central element and are connected to the collectors by end portions converging on the respective collectors. The respective collectors have an appendix extending outwardly beyond the window weatherstripping to serve as a terminal for connection to a power source.

Also known at the time of the invention described in this specification, is an electrical heater plate 10 such as shown in FIG. 1 of the drawings. Such an electric heater plate 10 is used in vehicles manufactured by the Ford Motor Company which are equipped with electrically heated backlites. In particular, the electrical heater plate is formed from a base which is a tempered glass sheet 12. The tempered glass sheet has a plurality of thin lines 14—14 of a silver ceramic material bonded to one surface of the tempered glass sheet. The method by which such thin lines are formed on the glass sheet is by a silk screening operation which is well known in the art. The materials used in the process are also well known in the art, for example, see Column 2 of the aforementioned U.S. Pat. No. 3,895,218.

At the left hand and right hand sides of the thin lines 14—14, only the right hand side being shown in FIG. 1, there is an enlarged interconnection strip 16 having a width greater than one-half inch and formed of silver ceramic material interconnecting the associated right hand or left hand ends of the thin lines 14—14. The interconnection strip also has associated therewith an enlarged termination area 18. A copper strip 20 is soldered at locations identified by the numeral 22—22 to the interconnection strip 16, whereby electrical interconnection is made along the interconnection strip 16. An electrical lead 24 is soldered at position 26 to the termination area 18 of the interconnection strip 16, whereby electrical interconnection may be made between the electrical lead 24 and an electrical circuit, not shown, which provides power to the lines 14—14, which in turn provides heat to the tempered glass sheet 12 in order to de-ice or de-fog the same.

The structure proposed in this application is one which substantially reduces the amount of silver ceramic material used to form an electrical heater plate which can be used, for example, as a rear window in a motor vehicle. The reduction in the amount of silver ceramic used provides two benefits. A first benefit is that the cost of the structure is reduced because less silver is used in forming the structure. The second benefit achieved is that the interconnection strip of a wide dimension, as identified by the numeral 16 in FIG. 1, is substantially eliminated and replaced by interconnecting structure which can be more easily hidden by moldings over the rear window when the window is an installed position in a motor vehicle.

SUMMARY OF THE INVENTION

This invention relates to an electric heater plate, and, more particularly, to an electric heater plate in which the plate is sheet of tempered glass which may be used as the backlite in a motor vehicle. The backlite is heated in order to defrost or de-fog the same.

In accordance with the general teachings of this invention, an electric heater plate has as its basic substrate a sheet of tempered glass. A plurality of thin lines of a silver ceramic material are bonded to one surface of the sheet of tempered glass and they extend in a generally parallel but spaced apart relationship, across a dimension of the sheet of tempered glass. Each of the plurality of thin lines have a left hand end portion and a right hand end portion defined at opposite ends thereof. A number of the plurality of thin lines form a group of thin lines. A pair of relatively thin interconnection strips of a silver ceramic material are bonded to the one surface of the sheet of tempered glass to which the thin lines are bonded. Individual ones of the pair of interconnection strips interconnect the left hand end portions and the right hand end portions of a group of the thin lines. A small terminal area of a silver ceramic material is associated with each of the interconnection strips. These small terminal areas are also bonded to the one surface of the sheet of tempered glass to which the thin lines are bonded. These terminal areas are interconnected with associated left hand or right hand interconnection strips. A pair of termination areas of silver ceramic material are also provided on the one surface of the sheet of tempered glass. These termination areas are located at a position spaced from the left hand and the right hand interconnection strips and terminal areas associated therewith.

A pair of thin copper strips are provided. One of these strips is bonded to each of the terminal areas and the termination area associated with either the left hand or the right hand interconnection strip thereby to electrically interconnect the same. A pair of electrical leads are also provided. One such electrical lead is connected to each of the pair of termination areas in order to provide a connection to an electric circuit of a motor vehicle, which in turn provides the electric power necessary to generate the heat in the silver ceramic material thereby to de-ice or de-fog the sheet of tempered glass.

BRIEF DESCRIPTION OF THE DRAWINGS

FIG. 1 is a drawing which depicts the prior art known in this area which has been described in the Background of the Invention and Prior Art Statement of this application.

FIG. 2 is an elevation view of an electric heater plate constructed in accordance with the teachings of this invention.

FIG. 3 is an enlarged drawing of the portion of the electric heater plate of FIG. 2, which is enclosed by the circle identified by the numeral 3.

DESCRIPTION OF THE PREFERRED EMBODIMENT

In FIG. 2, there is seen an electric heater plate generally identified by the numeral 30 which is constructed in accordance with the teachings of this invention. As seen in FIG. 2, the electric heater plate is formed on a sheet of tempered glass 32 which in accordance with the teachings of the preferred embodiment of this invention is a sheet of glass which is used as a backlite for an automotive vehicle. As shown in FIG. 2, the sheet of tempered glass has a plurality of thin lines 34—34 of a silver ceramic material bonded to one surface thereof. In general, the one surface of the sheet of tempered glass is that surface which faces the interior of the vehicle when the sheet of tempered glass is located in an installed position. The plurality of thin lines 34—34 extend in a generally parallel but spaced apart relationship across a dimension of a sheet of tempered glass. In the preferred embodiment, the parallel lines extend across the length of the glass sheet as seen in FIG. 2.

These plurality of thin lines 34—34 are formed from a silver ceramic material. The silver ceramic material is applied in a conventional manner through a silk screen printing operation. A low resistance, conductive silver paste is applied through a suitable silk screen. As it passes through this screen, it adheres to the sheet of glass 32. Typical of low resistance, conductive silver pastes that may be used are Drakefeld silver paste A653, or Englehard Hanovia silver paste 9124, both commercially available. The conductive silver pastes are finely divided particles of silver milled in squegee oil and other organic additives and ceramic materials to facilitate silk screening of the paste. The additives burn out during the firing of the device.

In actual processing, an untempered sheet of glass has a silver paste applied thereto. The silver paste and glass are heated to a temperature in the range of about 600° C to 625° C for from four to five minutes in a tempering furnace. This temperature is above the strain point of the glass. During the heating of the glass, the fine silver particles bond to the glass by a bond believed to be in part chemical and in part mechanical. The glass sheet is subsequently cooled at a rapid rate to room temperature in order to temper the same and produce a tempered sheet of glass having the silver ceramic material bonded thereto.

In accordance with the teachings of this invention, each of a plurality of thin lines 34 have left hand end portions 36 and right hand end portions 38 at opposite ends thereof. In accordance with further teachings of this invention, a number of the plurality of thin lines 34—34 are formed into a group of thin lines. For example, in FIG. 2 the upper three thin lines shown form a first group A of thin lines and the lower three lines form a group B of thin lines.

A pair of relatively thin interconnection strips 40—40 of the same silver ceramic material are also formed on and bonded to the one surface of the sheet of tempered glass 32 to which the plurality of thin lines 34—34 of group A are connected. Individual ones of these interconnection strips 40—40 have a thickness of about 0.060 inches and interconnect either the left hand end portions 36 or the right hand end portions 38 of the group of thin lines 34—34 designated by the letter A. In a similar manner, interconnection strips 42—42, also having a thickness of about 0.060 inches, interconnect the left hand end portions 36—36 and right hand end portions 38—38 of the group of thin lines 34—34 of group B.

A small terminal area 44, having a width and length about 0.190 inches, also formed of a silver ceramic material in the silk screen printing operation, is associated with each of the interconnection strips 40—40 and 42—42. Each of these terminal areas 44—44 is bonded to the one surface of the sheet of tempered glass 32 to which the plurality of thin lines 34—34 are bonded. These individual terminal areas 44—44 are interconnected with an associated left hand or right hand interconnection strip 40—40, 42—42.

A left hand termination area 46 and a right hand termination area 48 are also provided which are formed of the silver ceramic material and laid down on the one surface of the sheet of tempered glass 32 in the same silk screening operation as produces the plurality of thin lines 34—34 and the interconnection strips 40 and 42. The termination areas are spaced below the group of lines A and B and generally have a surface area directly below their associated termination areas 44—44.

In accordance with the further details of the apparatus of this invention, a left hand thin copper strip 50 and right hand thin copper strip 52 are also provided. These thin copper strips may have a coating of solder thereover so that they may be soldered respectively to the termination areas 44—44 and the left hand termination area 46 and right hand termination area 48, as indicated by solder connections designated by the numeral 54. As is best seen in FIG. 2, the solder connections 54 are made right on the termination areas 44—44 for the left and right hand sides of each group A and B of thin lines 34—34. Instead of coating the copper strips 50 and 52 with solder, individual amounts of solder may be placed between the terminal areas 44—44 and the left and right hand termination areas 46 and 48 and the copper strips in order to effect the solder connection 54 between these elements.

Electrical leads 56 and 58 are respectively soldered to the left hand termination area 46 and the right hand termination area 48 to provide leads to the electric supply circuits of the motor vehicle in a known manner whereby a current may be applied therebetween in order to heat the sheet of tempered glass 32 to defrost and de-ice the same when required.

Separation of the thin lines 34—34 into groups of lines A and B is also of value from the standpoint that if one of the solder connections 54 comes loose, the associated group of lines is disconnected from the power source. In such a manner, power is not fed to the group of lines from a remote location, which action can cause localized overheating of the glass sheet which can result in breakage thereof.

The structure disclosed in this application is one which substantially reduces the amount of silver ceramic material necessary to define the electric heater pattern on the sheet of tempered glass. The reduction in the amount of silver used, of course, reduces the cost involved in manufacturing this unit. Also, because the individual lines, in particular the interconnection strips, are reduced in size, they may be located nearer the side edges of the sheet of tempered glass. Such a location for these interconnection strips means that one may more easily cover the same with the molding strips that are used about the outside of the tempered glass sheet after it has been installed in a motor vehicle. Covering of the relatively thin interconnection strips, the terminal areas, termination areas, and thin cooper strips, makes the whole structure more asthetically pleasing to the consumer than a structure in which such elements are visible when viewed from the rear of the vehicle.

While the preferred embodiment has shown two groups of thin lines, it is apparent that the number of groups may be one or more, depending upon the dimension of the backlite to be covered by the plurality of thin lines. In some applications, three, four or more groups of lines may be necessary, whereas in other applications only a single group of lines would be necessary.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. An electric heater plate comprising:

a sheet of tempered glass, a plurality of thin lines of a silver ceramic material bonded to one surface of said sheet of tempered glass and extending in a generally parallel but spaced apart relationship across a dimension of said sheet of tempered glass, each of said plurality of thin lines having left hand and right hand end portions defined at opposite ends thereof, a number of said plurality of thin lines forming a group of thin lines, a pair of relatively thin interconnection strips of a silver ceramic material bonded to said one surface of said sheet of tempered glass, individual ones of said pair of interconnection strips interconnecting said left hand and right hand end portions of a group of said thin lines, a small terminal area of a silver ceramic material associated with each of said interconnection strips, each of said terminal areas being bonded to said one surface of said sheet of tempered glass, said terminal area being interconnected with its associated left hand or right hand interconnection strip, a pair of termination areas of silver ceramic material, one of said pair of termination areas being bonded to said one surface of said sheet of tempered glass at a position spaced from and out of contract with said thin lines said left hand and right hand interconnection strips and said small terminal areas, a pair of thin copper strips, one of said copper strips being bonded to each of said terminal areas and said termination area associated with said left hand or said right hand interconnection strip to electrically interconnect the same, and a pair of electrical leads, one connected to each of said pair of termination areas.

2. An electric heater plate comprising:

a sheet of tempered glass, a plurality of thin lines of a silver ceramic material bonded to one surface of said sheet of tempered glass and extending in a generally parallel but spaced apart relationship across a dimension of said sheet of tempered glass, each of said plurality of thin lines having left hand and right hand end portions defined at opposite ends thereof, a number of said plurality of thin lines forming a group of thin lines, said plurality of thin lines being divided into at least two groups of lines, a pair of relatively thin interconnection strips for each group of lines, each of said pair of interconnection strips of a silver ceramic material bonded to said one surface of said sheet of tempered glass, individual ones of each of said pair of interconnection strips interconnecting said left hand and right hand end portions of a group of said thin lines, a small terminal area of a silver ceramic material associated with each of said interconnection strips, each of said terminal areas being bonded to said one surface of said sheet of tempered glass, said terminal area being interconnected with its associated left hand or right hand interconnection strip, a pair of termination areas of silver ceramic material, one of said pair of termination areas being bonded to said one surface of said sheet of tempered glass at a position spaced from and out of contract with said thin lines said left hand and right hand interconnection strips and said small terminal areas, a pair of thin copper strips, one of said copper strips being bonded to each of said terminal areas and said termination area associated with said left hand or said right hand interconnection strips to electrically interconnect the same, and a pair of electrical leads, one connected to each of said pair of termination areas.

* * * * *